US009786249B2

(12) United States Patent
Johnson

(10) Patent No.: US 9,786,249 B2
(45) Date of Patent: Oct. 10, 2017

(54) FRAME TIMING

(71) Applicant: OMNIVISION TECHNOLOGIES, INC., Santa Clara, CA (US)

(72) Inventor: Kevin Johnson, Mundelein, IL (US)

(73) Assignee: OmniVision Technologies, Inc., Santa Clara, CA (US)

( * ) Notice: Subject to any disclaimer, the term of this patent is extended or adjusted under 35 U.S.C. 154(b) by 140 days.

(21) Appl. No.: 14/973,476

(22) Filed: Dec. 17, 2015

(65) Prior Publication Data

US 2017/0178552 A1 Jun. 22, 2017

(51) Int. Cl.

| | |
|---|---|
| ***G09G 5/00*** | (2006.01) |
| ***G09G 3/00*** | (2006.01) |
| ***G09G 3/20*** | (2006.01) |

(52) U.S. Cl.

CPC ..... *G09G 5/008* (2013.01); *G09G 3/2096* (2013.01); *G09G 5/005* (2013.01); *G09G 2310/08* (2013.01)

(58) Field of Classification Search

CPC ..... G09G 5/008; G09G 5/005; G09G 3/2096
See application file for complete search history.

(56) References Cited

U.S. PATENT DOCUMENTS

| | | | | |
|---|---|---|---|---|
| 6,043,803 | A * | 3/2000 | Shimizu | G09G 5/008 345/213 |
| 6,538,648 | B1 * | 3/2003 | Koike | G09G 5/005 345/213 |
| 2007/0222774 | A1 | 9/2007 | Foster | |
| 2009/0273556 | A1 | 11/2009 | Shimoshikiryoh et al. | |
| 2015/0123963 | A1 * | 5/2015 | Tsai | G09G 3/2096 345/213 |

OTHER PUBLICATIONS

ROC (Taiwan) Patent App. No. 105141923—First Office Action with English Translation, dated Jul. 26, 2017, 9 pages.

* cited by examiner

*Primary Examiner* — Kevin M Nguyen
(74) *Attorney, Agent, or Firm* — Christensen O'Connor Johnson Kindness PLLC

(57) ABSTRACT

A display system includes a processor coupled to receive image data from an image source and a frame timing circuit. The processor is coupled to output the image data and first sync signals, where each one of the first sync signals is output after M number of pixel values of the image data are output from the processor. The frame timing circuit is coupled to the processor to receive the image data and the first sync signals. The frame timing circuit is coupled to output X number of pixel values of the image data and second sync signals to a display, where the X number of pixel values is an integer multiple of the M number of pixel values of the image data. Each one of the second sync signals is output after X number of pixel values of the image data are output from the frame timing circuit.

21 Claims, 3 Drawing Sheets

FRAME TIMING

TECHNICAL FIELD

This disclosure relates generally to display technologies, and in particular but not exclusively, relates to frame timing.

BACKGROUND INFORMATION

Flat-panel displays have become ubiquitous. They are widely used in digital still cameras, cellular phones, security systems, as well as, medical, automobile, and other applications. Many modern flat-panel displays use backlit liquid crystal technology; however, other types of flat panel displays may use light emitting diodes (LEDs), organic LEDs, plasma panels, electroluminescent panels, or the like.

Flat panel displays may be volatile, meaning that the pixels are periodically refreshed to retain their state even when showing a static image. This refresh may occur many times every second. If the image is not refreshed the pixels may gradually lose their coherent state and the image will fade. Typically, individual rows of pixels that make up the display are refreshed one at a time cycling from one end of the screen to the other.

However, because of different screen sizes and refresh rates, displays may only be compatible with pieces of hardware specifically designed for one screen. Accordingly, image data from one device may not display properly (or at all) if that device is used in conjunction with an incompatible display.

BRIEF DESCRIPTION OF THE DRAWINGS

Non-limiting and non-exhaustive examples of the invention are described with reference to the following figures, wherein like reference numerals refer to like parts throughout the various views unless otherwise specified.

Figure 1:
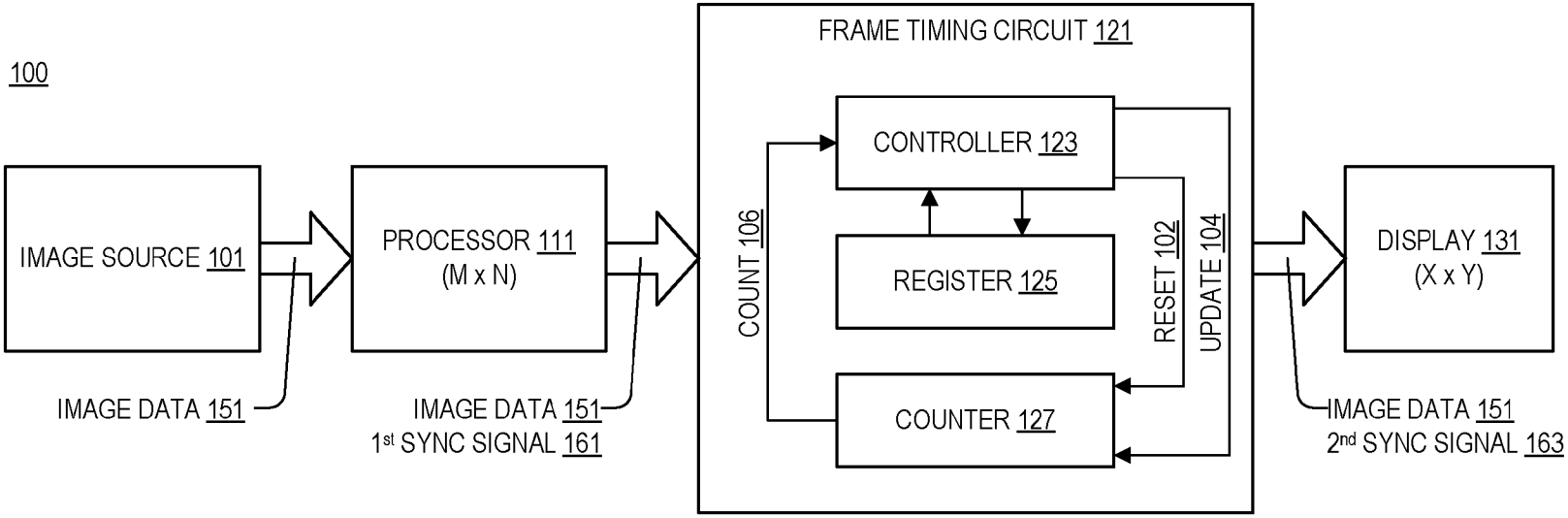
FIG. 1 is an illustration of a display system, in accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

Examples of an apparatus and method for frame timing are described herein. In the following description, numerous specific details are set forth to provide a thorough understanding of the examples. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one example" or "one embodiment" means that a particular feature, structure, or characteristic described in connection with the example is included in at least one example of the present invention. Thus, the appearances of the phrases "in one example" or "in one embodiment" in various places throughout this specification are not necessarily all referring to the same example. Furthermore, the particular features, structures, or characteristics may be combined in any suitable manner in one or more examples.

Throughout this specification, several terms of art are used. These terms are to take on their ordinary meaning in the art from which they come, unless specifically defined herein or the context of their use would clearly suggest otherwise.

FIG. 1 is an illustration of display system 100. Display system 100 includes: image source 101, processor 111, frame timing circuit 121, and display 131. Within frame timing circuit 121 are controller 123, register 125, and counter 127. As depicted, controller 123 may be coupled to counter 127 to send reset signal 102 to counter 127, and send update signal 104 to counter 127. Counter 127 may be coupled to controller 123 to provide count signal 106. In one example, counter 127 is coupled to controller 123 to provide the value stored on counter 127 to controller 123.

In the depicted example, processor 111 is coupled to receive image data 151 from image source 101. Processor 111 is further coupled to output image data 151 and first sync signals 161 to frame timing circuit 121. It is worth noting that first sync signals 161 are periodic, and each one of first sync signals 161 is output after M number of pixel values of image data 151 are output from processor 111.

As stated, frame timing circuit 121 is coupled to processor 111 to receive M number of pixel values of image data 151 and first sync signals 161. Frame timing circuit 121 is also coupled to output X number of pixel values of image data 151 and second sync signals 163 to display 131. In one example, the first sync signals 161 and the second sync signals 163 are horizontal sync signals that are output for each display line. In the depicted example, X number of pixel values is an integer multiple of the M number of pixel values of the image data 151, and each one of second sync signals 163 is output after X number of pixel values of image data 151 are output from frame timing circuit 121. In other words, frame timing circuit 121 may receive several sets of image data 151 from processor 111, with each set of image data 151 containing M number of pixel values. Frame timing circuit 121 will then send out one set of image data 151 (X number of pixel values) containing the several sets of image data 151.

In the illustrated example, register 125 is coupled to store an integer value equal to X/M, and counter 127 is coupled to count a number of first sync signals 161 received by frame timing circuit 121. For instance, in one example X=3840, M=1920, and X/M therefore equals 2. Controller 123 is coupled to register 125 and counter 127, and controller 123 is coupled to update (e.g., via update signal 104) a value stored on counter 127 in response to receiving first sync signals 161. Controller 123 is further coupled to reset counter 127 (via reset signal 102) in response to receiving the integer value of first sync signals 161. Frame timing circuit 121 is coupled to output second sync signals 163 in response to receiving the integer value of first sync signals 161. In one example, the integer value of X/M may be equal to an integer between 1 thorough 4, where the integer is inclusive of 1 and 4. To illustrate by way of example, where frame timing circuit 121 receives three first sync signals 161 and outputs a single second sync signal 163 to display 131, the integer value of X/M is three. In one example, display 131 has dimensions of X by Y and processor 111 is configured to output image data 151 in the form of M by N. Thus the ratio between the processor output and the display resolution is X/M.

Processor 111 may be coupled to frame timing circuit 121 to set the integer value (e.g., X/M) in register 125. Alternatively, controller 123 may be coupled to set the integer value in register 125. In one example, controller 123 may extract the pixel width of display 131 (X) from display 131, and controller 123 may extract the pixel width output (M) from processor 111. In this example, controller 123 may then divide the pixel width of display 131 with the pixel width output of processor 111 (X/M) to set the integer value in register 125. In a different example, the integer value stored on register 125 may be fixed. In one example, the integer value may be fixed during manufacturing of frame timing circuit 121.

In operation, display system 100 allows for an elegant way to convert an image data signal intended to be displayed on a display of one size (M by N pixels) into a data signal to be displayed on a display/screen of a different size (X by Y). In one example, image source 101 is included in display system 100 and image source 101 includes an image sensor. Image source 101 may send image data 151 to processor 111, which may format the data into a format compatible to be displayed on a screen (e.g., add first sync signal 161 to make image data 151 fit the horizontal dimensions of the screen). Frame timing circuit 121 may allow for image data 151 to be reformatted to fit to a screen with different dimensions by removing first sync signal 161 and adding second sync signal 163 at an appropriate interval.

Figure 2:
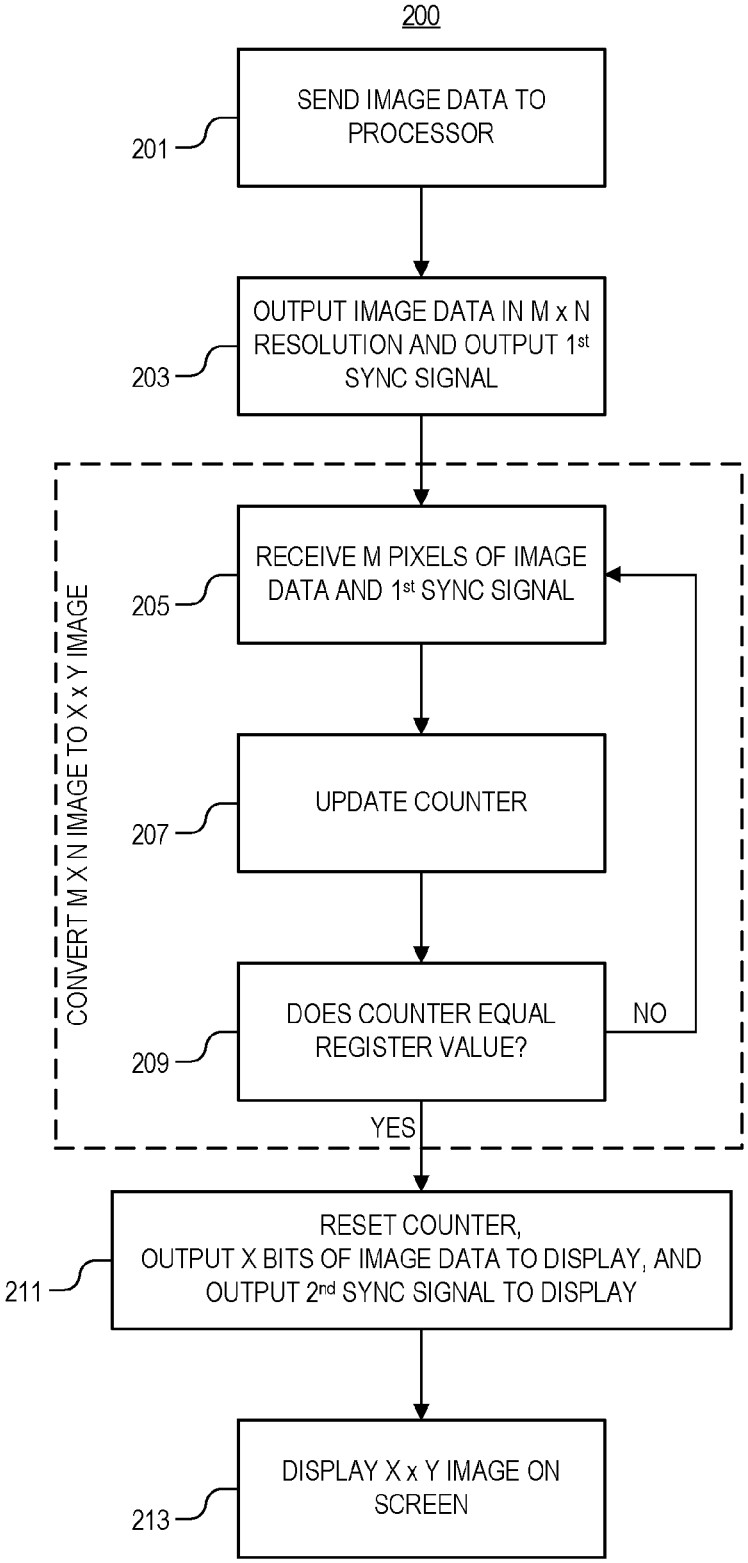
FIG. 2 is an example method of image processing, in accordance with the teachings of the present invention.

FIG. 2 is an example method 200 of image processing (e.g., the method employed by display system 100). The order in which some or all of process blocks 201-213 appear in method 200 should not be deemed limiting. Rather, one of ordinary skill in the art having the benefit of the present disclosure will understand that some of method 200 may be executed in a variety of orders not illustrated, or even in parallel. Further, method 200 is one possible method in accordance with the teachings of the present invention. Other methods have not been shown (which may include more process blocks and/or omit other process blocks) in order to avoid obscuring certain aspects of the disclosure.

Process block 201 shows sending image data (e.g., image data 151) to processor (e.g., processor 111). In one example, this may include receiving image data from an image source with a processor coupled to the image source.

Process block 203 depicts using the processor to output image data in an M by N pixel value format and output a $1^{st}$ sync signal for every M pixels per display line. In method 200, the processor outputs the image data and the first sync signals to a frame timing circuit (e.g., frame timing circuit 121). In one example, processor is configured to output the image data to a first display, and the dimensions of the first display are M by N.

Process block 205 illustrates receiving M pixels of image data and the $1^{st}$ sync signal with a frame timing circuit. In method 200, each one of the first sync signals corresponds to receiving M number of pixel values of the image data.

Process block 207 shows counting the number of first sync signals received, and after receiving each first sync signal, updating a value on the counter (e.g., increment, decrement, register shift, etc.) in response to receiving the first sync signals.

Process block 209 shows comparing the value on the counter and the value of the integer stored in the register. In one example, a controller is used to compare the value stored on the counter to the integer value stored on the register. It is worth noting that the integer value on the register may equal an integer value of X/M. If the value on the counter does not equal the value on the register, then the frame timing circuit will receive M more pixels of image data and again compare the value stored on the counter to the integer value stores on the register. However, when the value stored on the counter equals the integer value stored on the register, the frame timing circuit will output X number of pixel values of the image data to a display (where X is an integer multiple of M), and output a second sync signal. In one example, the integer value of X/M is equal to an integer between 1 thorough 4, where the integer is inclusive of 1 and 4. In other examples, it is appreciated that X/M may be equal to other values.

Process block 211 depicts outputting X number of pixel values of the image data to a display (where X is an integer multiple of M), and outputting a second sync signal. After the second sync signal is output, the counter is reset with a signal from the controller.

Process block 213 shows receiving/displaying X number of pixel values of the image data on a display, where dimensions of the display are X by Y. It should be noted that X number of pixel values of the image data may be displayed on a single image line of the display.

Although in one example, method 200 is occurring in discrete devices, in another example, the controller, the register, and the counter, are included in the frame timing circuit. Further, the image source, processor, frame timing circuit, and display may all be contained in one device (e.g., a cell phone).

Figure 3A:
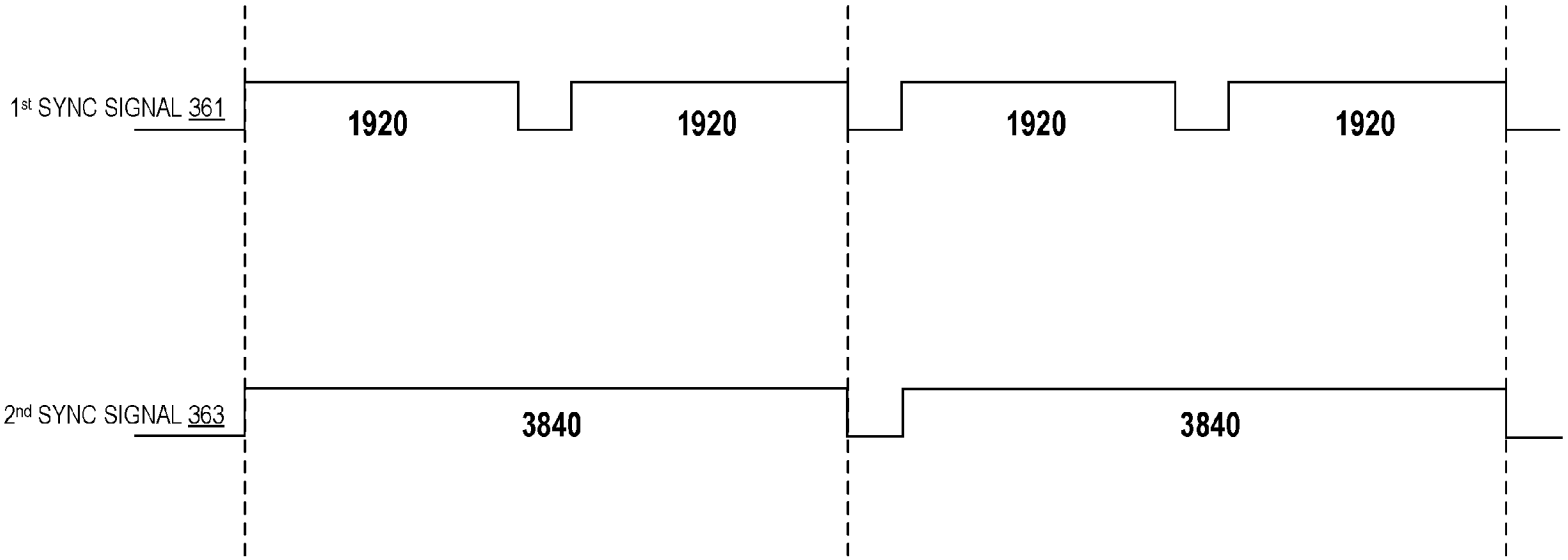
FIG. 3A is an example timing diagram, in accordance with the teachings of the present invention.

FIG. 3A is an example timing diagram. In the depicted example, the processor (e.g., processor 111) is sending a first sync signal 361 after every 1920 pixel values (e.g., M=1920 pixels) of image data are sent from the processor. It should be noted that the first sync signal 361 corresponds to the logic-lows in FIG. 3A. In one example, first sync signal 361 is a horizontal sync (or HSYNC) signal that indicates to a display the start of a new line of pixel values.

Second sync signal 363 is sent from frame timing circuit (e.g., frame timing circuit 121) after the frame timing circuit receives two first synch signals 361 and 3840 pixel values (e.g., X=3840 pixels) of image data. This allows the image data sent from the processor (which should have only been compatible with a 1920×640 pixel display) to be displayed on a screen with a resolution of 3840 by 320 pixels. It should be noted that in the depicted example, the processor outputs a vertical sync (VSYNC) signal after it outputs 640 lines of pixel data. Frame timing circuit may remove this signal and output a second VSYNC signal every 320 lines of the display (e.g., display 131). Frame timing circuit may scale this VSYNC signal adjustment for any display dimensions and processor output. In one example, the VSYNC signal is output every Y lines.

In one example, if a particular first sync signal 161 (e.g., a VSYNC signal) is received by frame timing circuit 121, and counter 127 is at a non-zero state, then controller 123 may (in some instances) send reset signal 102 to counter 127 to reset counter 127. This use of reset signal 102 may help mitigate an error made by frame timing circuit 121. For example, processor 111 may output an image with a pixel resolution of 600 by 400 to frame timing circuit 121, and frame timing circuit 121 may output an image with a pixel resolution of 1200×200 to display 131. If frame timing circuit 121 receives a particular first sync signal 161 (e.g., a VSYNC signal), then counter 127 may transition from its non-zero state to zero even if counter 127 is not at its natural transition point (e.g., counter 127 normally switches back to zero after receiving 1199 pixels, but a VSYNC signal is received by frame timing circuit 121 after frame timing circuit 121 received 1195 pixels, so counter 127 is reset to zero). This allows counter 127 to be properly reset despite an error occurring in frame timing circuit 121. However, it is worth noting that in some examples counter 127 may not count linearly and be reset to a non-zero base value.

Figure 3B:
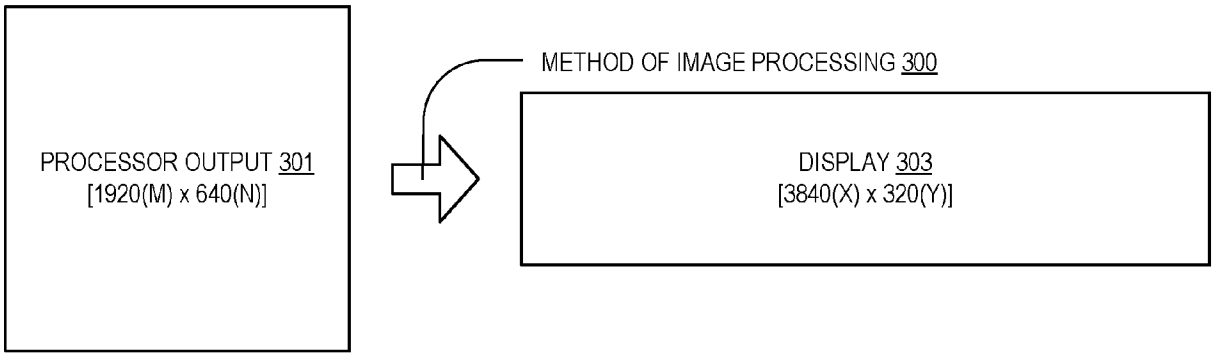
FIG. 3B is an example of possible processor output and display configurations, in accordance with the teachings of the present invention.

FIG. 3B is an example of possible processor output 301 and display 303 configurations. The depicted example shows a processor output 301 and display 303 configuration corresponding to the first sync signal 361 and second sync signal 363 shown in FIG. 3A. In the depicted example, processor output 301 corresponds to a display with a pixel resolution of 1920 by 640; however, the display client (display 303) is designed to display an image of 3840 pixels by 320 pixels. Accordingly, if the processor was directly connected to display 303, the two components would be incompatible. However, method of image processing 300 (which may correspond to method 200 of FIG. 2) may be used to convert processor output 301 into a format that may be properly used by display 303. Thus the image data that was output by processor output 301 may be converted into a 3840 by 320 image for use with display 303.

Although the examples depicted in FIGS. 3A-3B only show a processor outputting 1920×640 pixel values of image data and the display receiving 3840×320 pixel values of image data, in one or more examples, other display/processor resolutions may be used. It should be noted that the techniques used in this disclosure to adjust data output from a processor (or other circuit elements) to fit another screen may be used in conjunction with other display sizes and processing components. For example, a processor may output 3840×320 pixel values of image data and a display could be designed to receive 7680×160 pixel values of image data. Conversely, a processor may output 7680×160 pixel values of image data and a display could be designed to receive an image of 3840×320 pixel values of image data.

The above description of illustrated examples of the invention, including what is described in the Abstract, is not intended to be exhaustive or to limit the invention to the precise forms disclosed. While specific examples of the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific examples disclosed in the specification. Rather, the scope of the invention is to be determined entirely by the following claims, which are to be construed in accordance with established doctrines of claim interpretation.

What is claimed is:

1. A display system, comprising:

a processor coupled to receive image data from an image source, wherein the processor is coupled to output the image data and first sync signals, and wherein each one of the first sync signals is output after M number of pixel values of the image data are output from the processor; and a frame timing circuit coupled to the processor to receive the image data and the first sync signals, wherein the frame timing circuit is coupled to output X number of pixel values of the image data and second sync signals to a display, wherein the X number of pixel values is an integer multiple of the M number of pixel values of the image data, and wherein each one of the second sync signals is output after X number of pixel values of the image data are output from the frame timing circuit.

2. The display system of claim 1, wherein the frame timing circuit includes:

a register coupled to store an integer value equal to X/M;

a counter coupled to count a number of first sync signals received by the frame timing circuit; and a controller coupled to the register and the counter, wherein the controller is coupled to update a value stored on the counter in response to receiving the first sync signals, and wherein the controller is coupled to reset the counter in response to receiving the integer value of the first sync signals.

3. The display system of claim 2, wherein the frame timing circuit is coupled to output the second sync signals in response to receiving the integer value of the first sync signals.

4. The display system of claim 2, wherein the counter is coupled to the controller to provide the value stored on the counter to the controller.

5. The display system of claim 2, wherein the display has dimensions of X by Y and wherein the processor is configured to output image data in the form of M by N.

6. The display system of claim 5, wherein the processor is coupled to set the integer value in the register.

7. The display system of claim 2, wherein the integer value of X/M is equal to an integer between 1 thorough 4, and wherein the integer is inclusive of 1 and 4.

8. The display system of claim 2, wherein the integer value stored on the register is fixed.

9. The display system of claim 1, wherein the image source is included in the display system, and wherein the image source includes an image sensor.

10. The display system of claim 1, wherein the first sync signals and the second sync signals are horizontal sync signals.

11. A method of image processing, comprising:

receiving image data and first sync signals with a frame timing circuit, wherein each one of the first sync signals correspond to receiving M number of pixel values of the image data;

counting a number of first sync signals received with a counter, and updating a value stored on the counter in response to receiving the first sync signals;

outputting, with the frame timing circuit, X number of pixel values of the image data to a display, wherein the display has a resolution of X by Y, and wherein X is an integer multiple of M;

outputting, with the frame timing circuit, second sync signals to the display, wherein each one of the second sync signals are output when the value stored on the counter equals an integer value stored on a register, and wherein the integer value on the register equals an integer value of X/M; and resetting the counter.

12. The method of claim 11, further comprising receiving image data from an image source, and wherein the image source is coupled to a processor, and wherein the processor outputs the image data and the first sync signals to the frame timing circuit.

13. The method of claim 12, wherein the processor is configured to output the image data to a first display, and wherein dimensions of the first display are M by N.

14. The method of claim 11, further comprising:

receiving the X number of pixel values of the image data with a second display, wherein dimensions of the second display are X by Y; and displaying the X number of pixel values of the image data on a single image line of the second display.

15. The method of claim 11, further comprising setting the integer value stored on the register, wherein the processor is coupled to set the integer value in the register.

16. The method of claim 11, further comprising:

using a controller to reset the counter; and comparing the value stored on the counter to the integer value stored on the register.

17. The method of claim 16, wherein the controller, the register, and the counter, are included in the frame timing circuit.

18. The method of claim 11, wherein the integer value stored on the register is fixed.

19. The method of claim 11, wherein the integer value of X/M is equal to an integer between 1 thorough 4, and wherein the integer is inclusive of 1 and 4.

20. The method of claim 11, wherein the first sync signals and the second sync signals are horizontal sync signals.

21. The method of claim 11, wherein resetting the counter occurs after receiving a particular first sync signal, and wherein resetting the counter mitigates an error made by the counter.

* * * * *